US005709016A

United States Patent [19]

Gulick et al.

[11] Patent Number: 5,709,016

[45] Date of Patent: Jan. 20, 1998

[54] READY-TO-ASSEMBLE CASKET

[75] Inventors: Kenneth J. Gulick, Ashland; Dennis C. Laphan, Cincinnati, both of Ohio; John R. Enneking, Batesville, Ind.; Carolyn Wetzler, West Chester, Ohio; Leslie W. Smith, Batesville, Ind.; James F. Kirschner, Batesville, Ind.; Gary L. Henby, Batesville, Ind.; Wilbur A. Schebler, Batesville, Ind.

[73] Assignee: Batesville Casket Company, Inc., Batesville, Ind.

[21] Appl. No.: 459,736

[22] Filed: Jun. 2, 1995

[51] Int. Cl.[6] ..... A61G 17/00

[52] U.S. Cl. ..... 27/2; 27/14; 27/17; 27/19

[58] Field of Search ..... 217/12 R, 13; 220/668, 4.28; 27/2, 14, 17, 19

[56] References Cited

U.S. PATENT DOCUMENTS

| | | | |
|---|---|---|---|
| D. 227,247 | 6/1973 | Dittbenner . | |
| 244,317 | 7/1881 | Sander . | |
| 768,481 | 8/1904 | Post . | |
| 900,968 | 10/1908 | Waldie et al. . | |
| 1,260,927 | 3/1918 | McKinney . | |
| 1,373,730 | 4/1921 | Hollins . | |
| 1,610,781 | 12/1926 | Hollins . | |
| 1,660,019 | 2/1928 | Tazza . | |
| 1,863,259 | 6/1932 | Van Buren . | |
| 2,030,588 | 2/1936 | Hedeen et al. . | |
| 2,111,337 | 3/1938 | Sherman . | |
| 2,338,035 | 12/1943 | Gerold . | |
| 3,007,224 | 11/1961 | Wean . | |
| 3,045,314 | 7/1962 | Miller . | |
| 3,077,016 | 2/1963 | White | 27/19 |
| 3,220,080 | 11/1965 | Connelly . | |
| 3,228,085 | 1/1966 | Nelson | 27/19 |
| 3,407,459 | 10/1968 | Elder | 27/19 |
| 3,490,114 | 1/1970 | Connelly et al. . | |
| 3,531,837 | 10/1970 | Cherry . | |
| 3,616,988 | 11/1971 | Weant . | |
| 3,729,786 | 5/1973 | Walding . | |
| 3,782,619 | 1/1974 | Dittbenner . | |
| 3,831,230 | 8/1974 | Rawlings | 27/19 |
| 3,835,509 | 9/1974 | Esterdahl | 27/19 |
| 3,879,818 | 4/1975 | Rowland . | |
| 3,924,309 | 12/1975 | Andrus, Jr. et al. . | |
| 3,962,761 | 6/1976 | Boughner . | |
| 3,964,140 | 6/1976 | Gauchard . | |
| 4,041,582 | 8/1977 | MacDonald . | |
| 4,146,948 | 4/1979 | Royce et al. . | |
| 4,151,630 | 5/1979 | Havey . | |
| 4,176,431 | 12/1979 | Havey, III . | |
| 4,195,394 | 4/1980 | Semon . | |
| 4,209,880 | 7/1980 | Lidholm . | |
| 4,357,741 | 11/1982 | Winburn et al. | 27/19 |
| 4,463,997 | 8/1984 | Densen . | |

(List continued on next page.)

OTHER PUBLICATIONS

The Complete Häfele Brochure.

*Primary Examiner*—Carl D. Friedman
*Assistant Examiner*—Beth Aubrey
*Attorney, Agent, or Firm*—Wood, Herron & Evans

[57] ABSTRACT

A casket is assembled from prefabricated components to provide an attractive and aesthetically appealing casket design with a minimum amount of metal components so that the casket is adapted for cremation. A shell of the casket is constructed from upstanding sidewalls with a peripheral frame and facing panel secured to the frame. The respective walls are joined by cooperating cam and post connectors that they can be easily assembled without skilled personnel or specialized tooling. A cap enclosing the casket shell is constructed with a peripheral rim formed from rim members also joined by the cam and post connectors. A dish assembly is positioned on an inside surface of the cap and includes puffing members which are securely retained within cooperating grooves on the rim and dish assembly to thereby avoid the need for metal staples or other mechanical fasteners. The panels of the casket are preferably formed by hardboard to provide a structurally rigid and stable shell without the need for additional reinforcing members and which are readily consumable in the cremation process.

43 Claims, 5 Drawing Sheets

U.S. PATENT DOCUMENTS 4,639,985 2/1987 Craft ..... 27/19
4,730,370 3/1988 Elder .
4,773,134 9/1988 Kay .
4,788,757 12/1988 Bethune et al. .
4,800,631 1/1989 Pellmann .
4,930,197 6/1990 McClive .
4,967,455 11/1990 Elder .
5,035,032 7/1991 Nutting .
5,207,343 5/1993 Bogadi ..... 220/4.28
5,222,281 6/1993 Guerin .
5,241,729 9/1993 MacKirdy .
5,495,648 3/1996 Rojdev ..... 27/19

READY-TO-ASSEMBLE CASKET

FIELD OF THE INVENTION

This invention relates to caskets, and more particularly to a casket which can be shipped in a knocked down configuration and then assembled at its destination.

BACKGROUND OF THE INVENTION

Caskets typically include a base or shell formed as a complete unit together with a lid or cap hinged to the base. The lid or cap may include a single element extending the full length of the casket or separate foot and head portions which may be capable of being individually opened and closed. Since the cap and shell are designed as a unit and coordinated with one another, typically the structure of the casket is completely or substantially completely manufactured at one facility and is shipped in a complete or substantially complete form to its destination. Such a casket occupies a large space, and as a result, shipping and storage costs are high.

The capability of promptly delivering any one of many types and styles of caskets from various and scattered distribution locations is desirable. Typically a large inventory of the various casket designs is required. In the past, one attempt to alleviate some of this problem is to accomplish some finishing operations, such as the attachment of handles, trim or other accessories, at the point of distribution and not at the manufacturer. However, this has the drawback of requiring relatively skilled workmanship and complicated tooling at widely scattered distribution locations. Typically, workers skilled with required complicated tooling and other assembly techniques are found at the casket manufacturer. As a result, caskets are built by the manufacturer to predetermined specifications and the opportunity for customized or individualized caskets is minimized.

Prefabricated or ready to assemble (RTA) caskets are known in the art. One such design is disclosed in U.S. Pat. No. 4,930,197. However, one problem associated with such casket designs up to now is their lack of structural rigidity and strength, or alternatively if the casket is sufficiently rigid the inordinate amount of internal reinforcing structure which must be assembled into the casket at its destination. The shell of the casket may not be strong enough to support the weight of the casket and corpse therein. Such caskets commonly include a reinforcing framework, system of braces, slings, straps or the like within the shell to compensate for the inadequate strength of the casket shell. To fully exploit the ready to assemble fabrication and assembly approach, the casket must require only a minimal number of fastening steps to be quickly assembled. Additional structural members spanning the inside of the shell for rigidity are thus not desirable since installation of same prolongs assembly of the casket.

Another type of casket commonly used in the industry is designed specifically for cremation. Crematory caskets have traditionally been fabricated of corrugated paperboard which may or may not be covered by cloth or other facing materials. Corrugated paperboard caskets offer the advantage that they burn relatively efficiently and cleanly in the crematory. However, paperboard crematory caskets are traditionally plain and not very aesthetically appealing, and are lacking in stiffness.

Standard hardwood caskets have traditionally been more attractive, but present problems when cremated. Such caskets take very long to burn and include many metal components which may present environmental or other problems in the cremation process. One source of metal commonly used in the construction of caskets is staples or other mechanical fasteners which are used to attach or install interior assemblies of the casket. The interior assemblies which are commonly secured to the casket include puffings and other lining materials for the shell and cap of the casket. As the metal components are burned in the crematory, they melt and may give off gases and/or adhere to fire brick and to bone fragments. As a result, the metal content in crematory caskets should be minimized.

SUMMARY OF THE INVENTION

It has therefore been an objective of this invention to provide a casket which can be stored or shipped with minimal space and cost associated therewith.

It has been a further objective of the invention to provide such a casket which has sufficient strength and structural integrity to support the weight of the casket and corpse therein without the need for additional reinforcing members in the shell.

It has been a further objective of the invention to provide such a casket which can be easily customized with individual features or designs.

It has been a still further objective of the invention to provide such a casket which is both appealing and attractive and can readily be used in a crematory without the problems associated with traditional hardwood caskets having a high metal content.

It has been yet a further objective of the invention to provide such a casket which is suitable for both above and below ground burial.

These and other objectives of the invention have been attained by a casket which can be assembled at a distribution center, funeral home, or the like without the need for specialized training, skills and/or complicated tools. The individual components are fabricated by the casket manufacturer and shipped in a knocked-down or RTA configuration to the distribution center, funeral director, or customer. Shipment of the components of the casket in a knocked-down or RTA configuration reduces the cost and space required for the transportation and storage of the casket. Further, the funeral home, distribution center or the like can maintain a large inventory of component parts with a minimal amount of storage space and expense. In addition, customized or individual casket designs can be created by mixing and matching various components of the caskets.

A casket according to a presently preferred embodiment of this invention includes a shell closeable by a cap. The shell is assembled from prefabricated parts and includes a plurality of upstanding walls attached to a bottom of the casket. Each wall is assembled from an upper, a lower and a pair of side frame members in a presently preferred embodiment of the invention. When joined together, the frame members form a peripheral frame having an opening. The opening is spanned by a panel attached to the frame to thereby form one of the walls of the casket shell. The panel is attached to the peripheral frame without staples or other metal components by a plastic push-in type fastener having a corrugated stem and enlarged head thereon in one presently preferred embodiment.

The individual frame members are joined together by cooperating cam and post connectors which require minimal skill for assembly and no specialized tools or training. The post projects from one of the frame members and into a post hole in the adjacent frame member. The cam is seated within the adjacent frame member in a bore hole which is in communication with the post hole such that when the post is inserted into the hole, it is seated within a slot of the cam. The cam is then rotated as by a screwdriver or other standard tool so that the cam slot captures and securely retains a head formed on the end of the post to thereby join the adjacent frame members together. The casket shell of this invention with such a construction is structurally rigid and sturdy and avoids the need for additional structural stiffeners or other members as is required with past RTA casket designs.

The assembly of the casket cap according to this invention likewise does not require staples and is easily accomplished without special tools or skills. The cap is constructed with a peripheral rim in which the rim members are joined together with the post and cam connectors as previously described. In one embodiment, the posts used for securing the adjacent rim members together have a pair of heads, one on each opposite end of the post, and a pivotal joint therebetween. This dual headed post is particularly adapted for joining the rim members together at a miter corner of the rim.

Each of the rim members has a slot or groove formed proximate a lower edge thereof. An opening formed by the rim is covered by a crown. A dish assembly is positioned on an underside of the crown and includes a wooden or plastic or other combustible, environmentally safe frame and a plurality of puffing members. The frame has a groove formed therein. The frame is positioned relative to the rim so that each puffing member has an edge inserted into the groove in one of the rim members and another edge inserted into the groove in the frame. With the edges of the puffing inserted into the grooves, the puffing is frictionally retained in the cap of the casket in a generally bowed configuration without the need for mechanical or metal fasteners. This allows for easy, on-site customization of cap panel designs.

The panels of the walls and bottom of the shell and of the cap in a presently preferred embodiment of the invention are constructed from hardboard. Other similar materials such as fiberboard, honey comb corrugated panels etc, may be used as long as they are sufficiently strong and combustible. Hardboard material is manufactured primarily from cellulosic fibers which are consolidated under heat and pressure in a hot press into a panel having a density typically over 31 pounds per cubic foot. Other additives can be included with the cellulosic fibers during the manufacture of the hardboard to improve specific physical properties such as stiffness, hardness, strength, and durability or finishing properties such as a resistance to abrasion and moisture. Further, the casket constructed with hardboard can be finished with a paper, cloth, plastic, or wood veneer or painted or printed to provide a variety of aesthetically appealing casket designs. Further, the hardboard has a relatively low cycle time in the cremation process and burns much quicker and cleaner than standard hardwood materials. Further, the panels could be "faced" on both sides, thereby being reversible.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
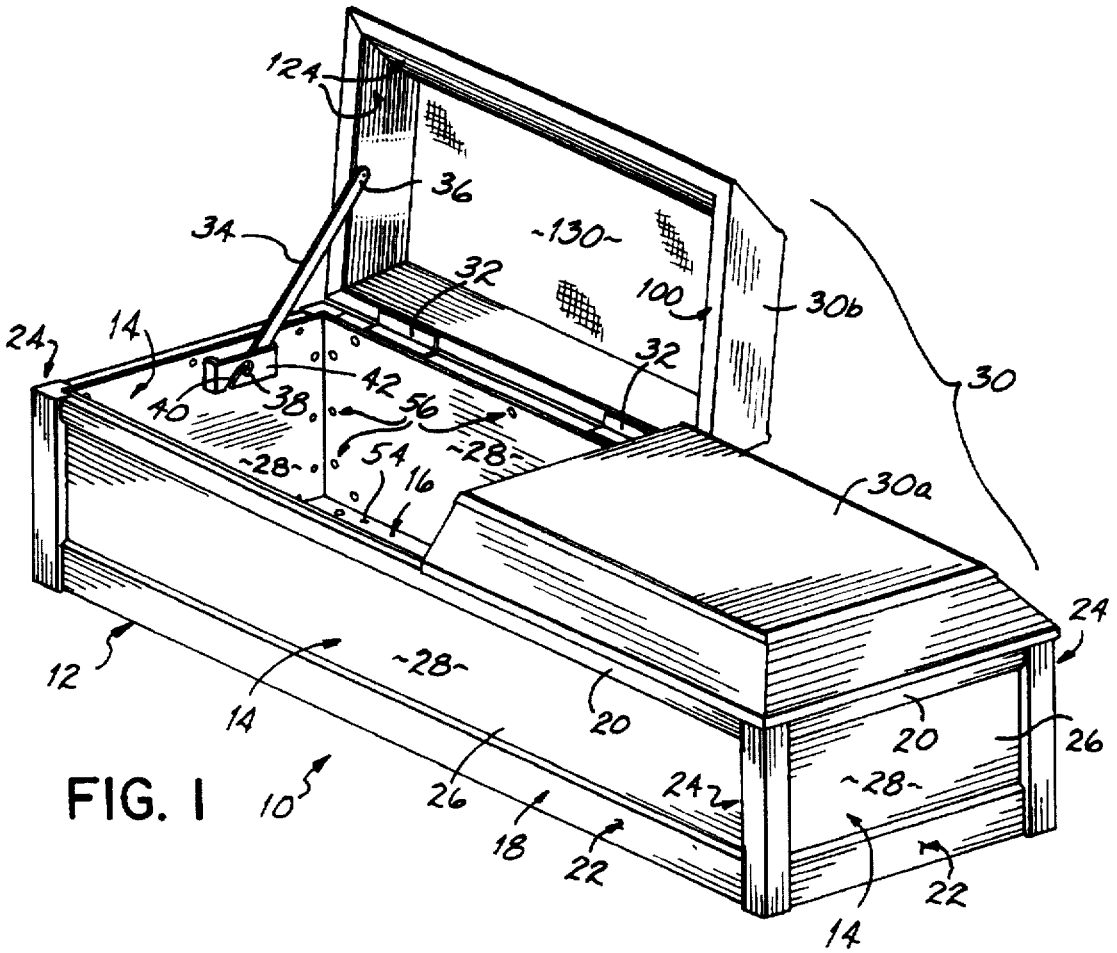
FIG. 1 is a perspective view of a casket according to this invention with a head cap section in the open configuration.

Referring to FIG. 1, a presently preferred embodiment according to this invention of a casket 10 is shown. The casket 10 includes a generally rectangular shell 12 with four upstanding interconnected walls 14 and a bottom 16. Each wall 14 includes a peripheral frame 18 constructed from an upper frame member 20, a lower frame member 22, and a pair of lateral side frame members 24, 24. The lateral side frame members 24 are proximate corners of the casket shell 12. The peripheral frame 18 of each wall 14 of the shell 12 defines an opening 26 which is covered or spanned by a panel 28 secured to the frame 18 as will be described in detail hereinbelow. The panel 28 is shown attached to an interior surface of the frame 18; however, it could readily be attached on the exterior surface or sandwiched between inner and outer frame members (not shown).

The casket 10 also includes a cap 30 positioned on the open upper edges of the shell 12. The cap 30 as shown in FIG. I includes a foot cap **30*a* and a head cap 30*b*. The head cap 30*b* is pivotally attached to an upper edge of the shell 12 as by hinges 32 so that the head cap 30*b* can be converted between an open configuration as shown in FIG. 1 and a closed configuration (not shown). The cap 30 is supported in the open configuration by a link 34 pivotally attached to the cap 30 at a first end as by a pin 36 or other suitable fastener. A second end of the link 34 is coupled to the casket shell 12 by a pin 38 which engages a slot 40 in a bracket 42 secured to the inside surface of the wall 14 as shown in FIG. 1. The link 34 and bracket 42** mechanism is fully disclosed in U.S. patent application Ser. No. 08/342,352, filed Nov. 18, 1994 which is assigned to the assignee of the present invention and hereby incorporated by reference.

Figure 2:
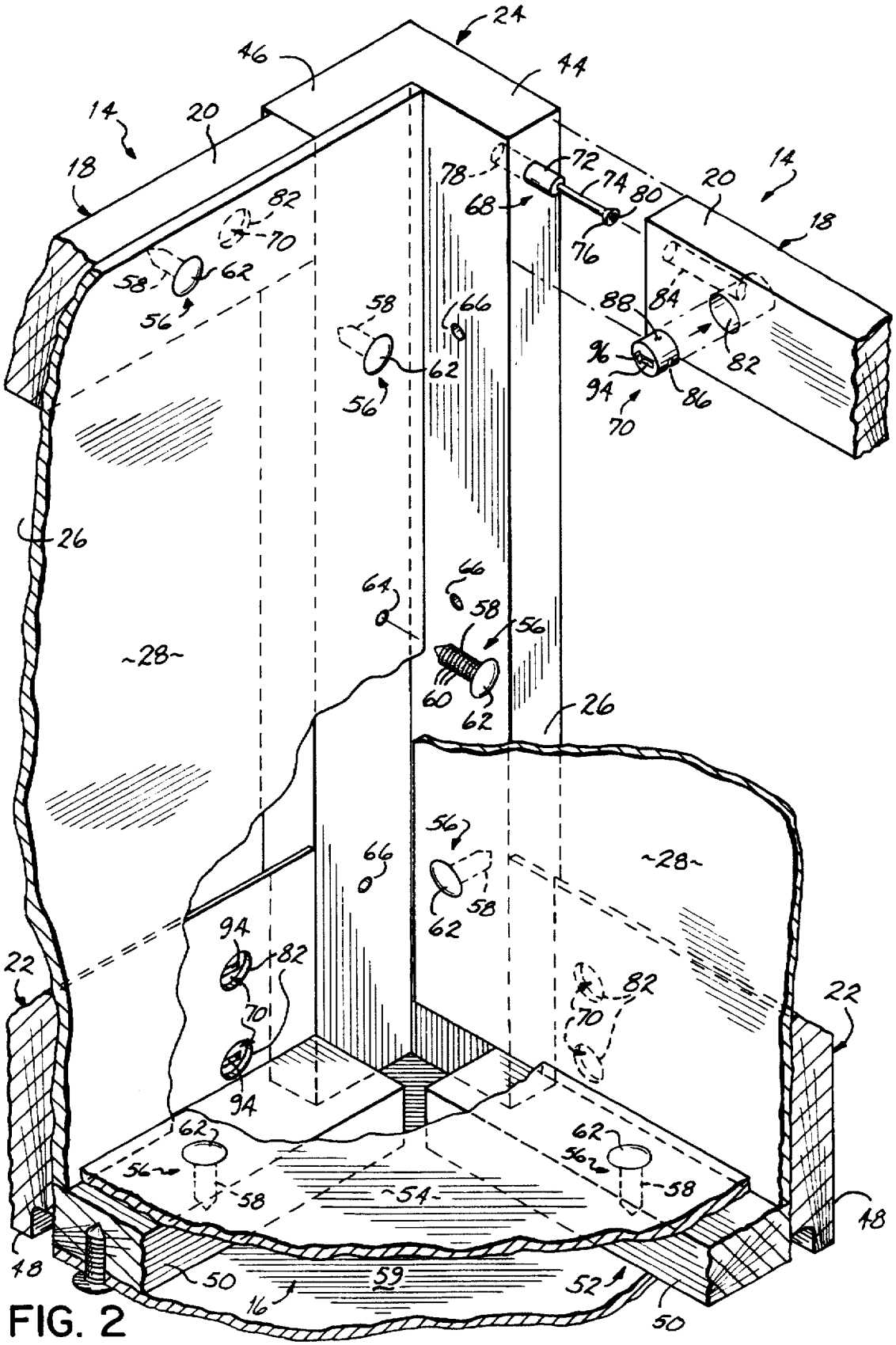
FIG. 2 is an enlarged broken away perspective view of the frame members, panels and bottom of the casket shell.
Figure 7:
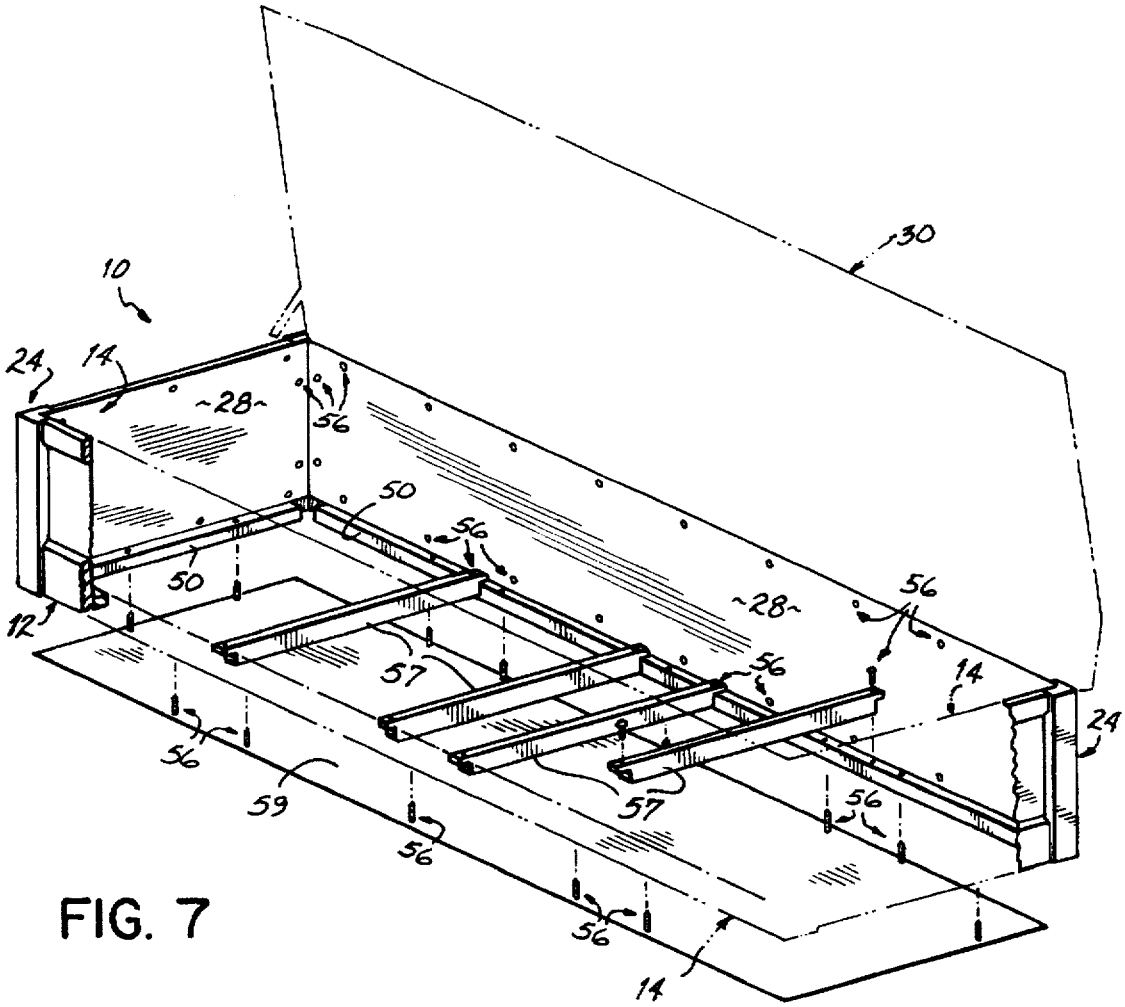
FIG. 7 is an exploded partial perspective view of the casket of this invention illustrating the bottom construction.

Referring to FIG. 2, each lateral side frame member 24 of the walls 14 of the casket 10 according to a presently preferred embodiment of this invention is generally L-shaped with a first leg 44 and a second leg 46 and forms a corner of the casket shell 12. The first leg 44 cooperates with the upper and lower frame members 20, 22 to form the peripheral frame 18 of one wall 14 of the casket shell 12 and the second leg 46 cooperates with the upper and lower frame members 20, 22 to form the peripheral frame 18 of an adjacent wall 14 of the casket shell 12. Similarly, each lower frame member 22 is generally L-shaped with a first leg 48 and a second leg 50. The first leg 48 of the lower frame member 22 cooperates with the other frame members 20 and 24 to form the peripheral frame 18 of the shell wall 14, and the second leg 50 cooperates with the second leg 50 of other lower frame members 22 to form a bottom peripheral frame 52. An interior bottom panel 54 is nested within the bottom frame 52 and is supported atop the second legs 50 of the lower frame members 22 and secured thereto with plastic fasteners 56 to thereby form the bottom 16 of the casket shell 12. As shown in FIG. 7, legs 50 having cross-members 57 spanning and attached to them via the fasteners 56. An exterior bottom panel 59 is mounted to legs 50 of members 22.

To minimize the metal components in the casket 10 and simplify the assembly thereof, the wall panels 28 and bottom panel 54 are conveniently secured to the respective frames 18 and 52 by a plastic fastener 56 in a presently preferred embodiment of the invention. The fastener 56 includes a corrugated stem 58 having a plurality of generally parallel plate-like extensions 60 on the stem 58. The fastener 56 also includes a disk-shaped head 62. The corrugated stem 58 projects through a hole 64 proximate an edge of the panel 28 or 54 and is frictionally retained within a hole 66 in the frame member 20, 22 or 24 to thereby attach the panel 28 or 54 to the frame 18 or 52. The fastener 56 can be pushed, forced or tapped into the holes 64, 66 manually or with a hammer or other similar tool for the easy attachment of the panel 28 or 54 to the frame 18 or 52. Alternatively, a combination of a cold glue, such as white wood glue, and hot melt glue could be used to secure the panel 28 or 54 to the frame 18 or 52. The hot melt glue sets quickly, typically within 30 seconds, and stabilizes the frame and panel until the cold glue sets up.

A post 68 is coupled to a cam 70 to join each of the frame members 20, 22 or 24 to an adjacent frame member 20, 22 or 24 according to a presently preferred embodiment of the invention as shown in FIGS. 2 and 3A–3D. Referring to FIG. 2, the post 68 includes a generally cylindrical trunk 72, which is preferably molded plastic, and a more narrow neck 74 extending from the trunk 72 and terminating at an enlarged head 76 of the post 68. The trunk 72 is inserted into a hole 78 in the outer edge of each leg 44 or 46 of the side frame member 24 and is securely retained therein. The trunk 72 in a presently preferred embodiment is press fit into the hole 78. Alternatively, the head 76 has a slotted aperture 80 so that the trunk 72 could be screwed into the hole 78 by a screwdriver in the aperture 80 and securely retained to the side frame member 24, or the post 68 could be secured to the frame member 24 by another method well known to those skilled in the art.

The cam 70 is seated within a bore hole 82 spaced from a lateral edge of the upper and lower frame members 20, 22. The bore hole 82 is in communication with a post hole 84 so that the head 76 and a portion of the post 68 project from the side frame member 24 through the post hole 84 and into the bore hole 82 of the upper or lower frame member 20 or 22. The cam 70 seated within the bore hole 82 in a presently preferred embodiment of the invention is generally cylindrical and includes a cam slot 86 formed in a sidewall 88 thereof. The cam slot 86 extends approximately 180° around the perimeter of the cam 70. A first end of the cam slot 86 includes an enlarged opening 90 sized for the insertion of the head 76 of the post 68 therein as shown particularly in FIG. 3A. An opposite end of the cam slot 86 includes a shoulder 92 designed to capture and retain the head 76 of the post 68 within the cam slot 86 as shown particularly in FIG. 3D. An upper surface of the cam includes a slotted aperture 92 with an arrow 94 or similar indicia pointing to the enlarged opening 90 of the cam slot 86. A cam and post suitable for use in the present invention are manufactured by Hafele America Company of Archdale, N.C. as "mini fix 15 housing" Part No. 262.16.357 and "mini fix 15 bolt" Part No. 262.10.300, respectively. Other equally acceptable products exist. While only the neck 74 and head 76 of the cam and post fastener supplied by Hafele are metal, with the balance of the cam and post fastener being plastic, it is preferred that the cam and post fastener be fabricated of plastic in its entirety to minimize the amount of metal used in the casket.

The attachment of the side frame member 24 to the adjacent upper or lower frame member 20 or 22 will now be described in detail with reference to FIGS. 3A–3D. With the cam 70 seated within the bore hole 82 and the enlarged opening 90 of the cam slot 86 aligned with the post hole 84, a lateral end of the upper or lower frame member 20 or 22 is juxtaposed to the side edge of the leg 44 or 46 of the side frame member 24 thereby inserting a portion of the post 68 into the post hole 84 and the head 76 into the enlarged opening 90 of the cam 70.

Figure 3A:
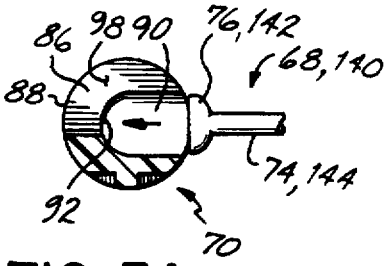
FIGS. 3A–3D are sequential cross-sectional views showing the interaction of the cam and post connector joining frame or rim members together according to one embodiment of this invention.
Figure 3C:
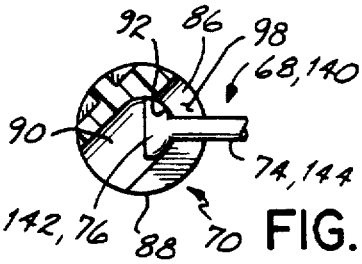
Figure 3B:
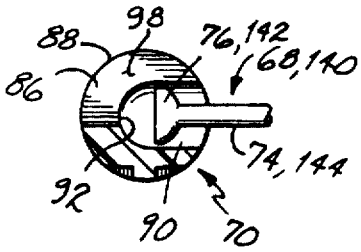
Figure 3D:
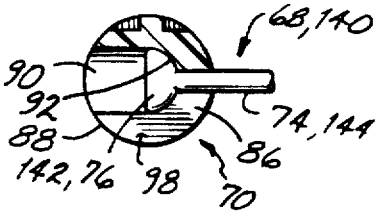

A slotted screwdriver (not shown) or other similar tool is inserted into the slotted aperture 94 of the cam 70 to rotate the cam 70 in the direction of arrow A of FIGS. 3B and 3C. As the cam 70 rotates, the neck 74 of the post 68 passes between sidewalls 98, 98 of the cam slot 86 as shown in FIG. 3C. With the continued rotation of the cam 70, the shoulder 92 of the cam slot 86 engages the head 76 of the post 68. The shoulder 92 is tapered to pull the post 68 and head 76 in the direction of arrow B and thereby securely fasten the frame members 20, 22 and/or 24 together when the cam 70 is completely rotated approximately 180° as shown in FIG. 3D. The cam 70 and post 68 operation provides a simple, secure and reliable attachment mechanism for various components of the invention in addition to those shown in FIG. 2. Alternatively, the fastener 56 or the like could be used to secure frame members 20 or 22 to member 24 in place of the post and cam configuration. It will be appreciated that other mechanisms for connecting the frame members 20, 22 and 24 together according to this invention can be employed without deviating from the scope of the invention. Further, the panels 28 or 54 could be attached to the frames 18 or 52 by the manufacturer prior to shipping the components of the casket 10 to their destination. With the frame members 20, 22 and 24 assembled as described into the peripheral frames 18 of the shell walls 14 and bottom 16 of the casket 10, a sturdy and rigid shell 12 is constructed according to this invention without additional structural members being required to reinforce the shell 12 as with prior art caskets previously described herein.

Figure 6:
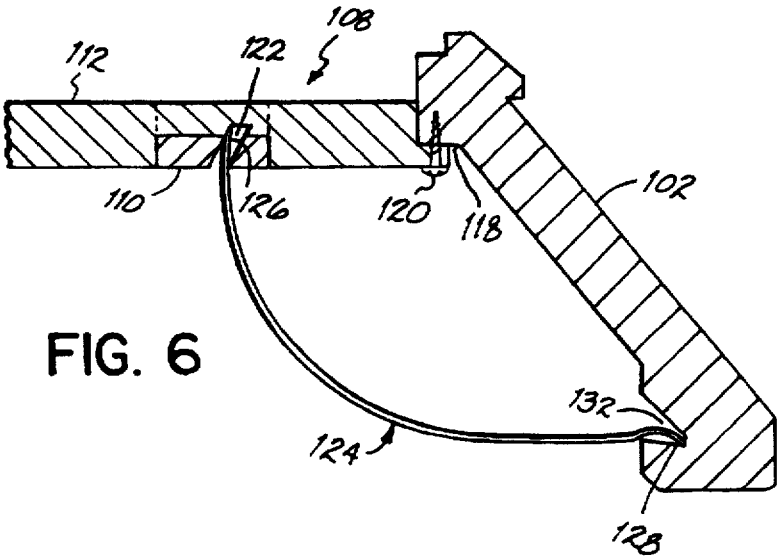
FIG. 6 is a cross-sectional view showing the attachment of a puffing member to the cap and dish assembly of FIG. 4.
Figure 4:
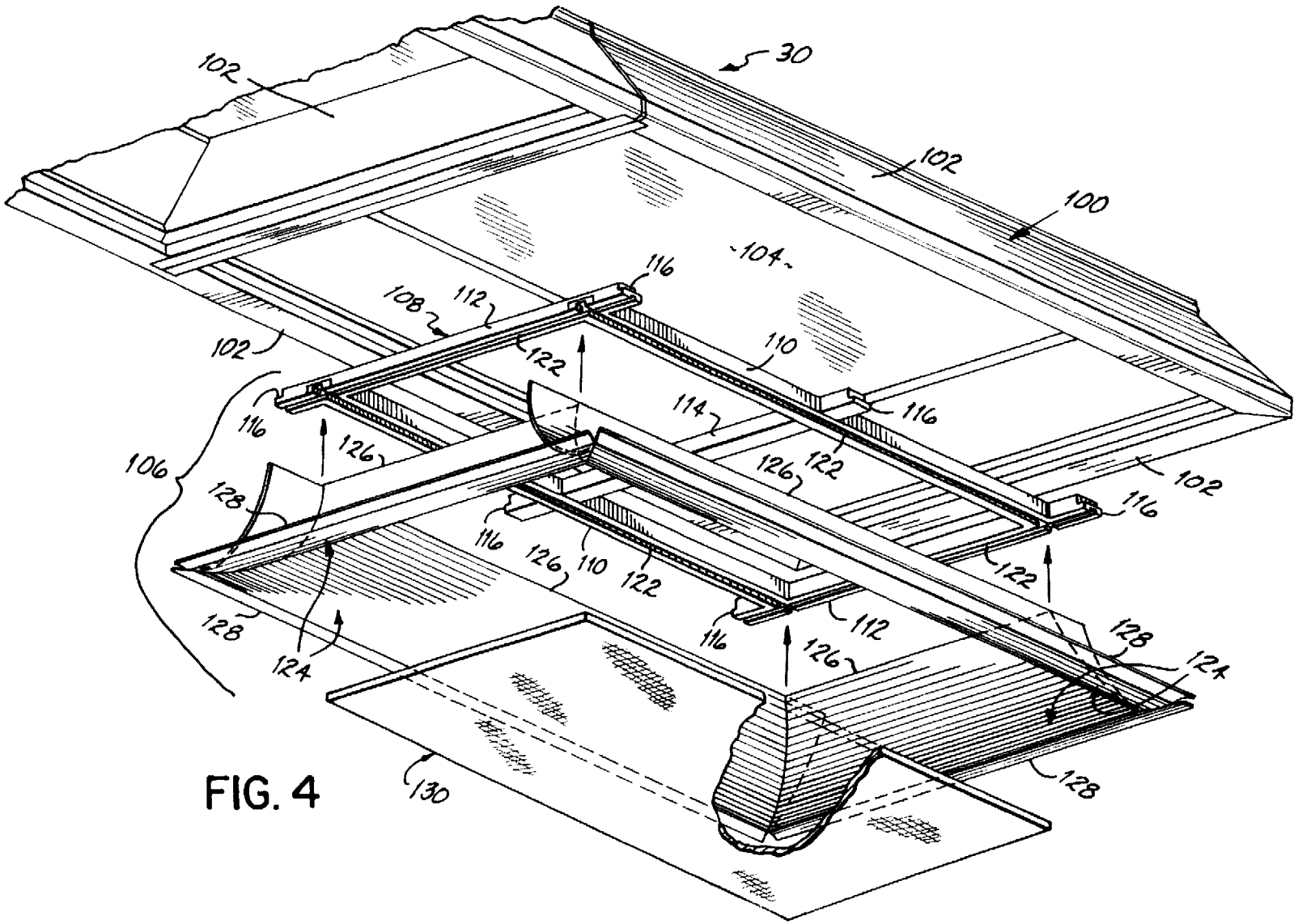
FIG. 4 is an exploded perspective view of the cap and dish assembly according to one embodiment of this invention.
Figure 5:
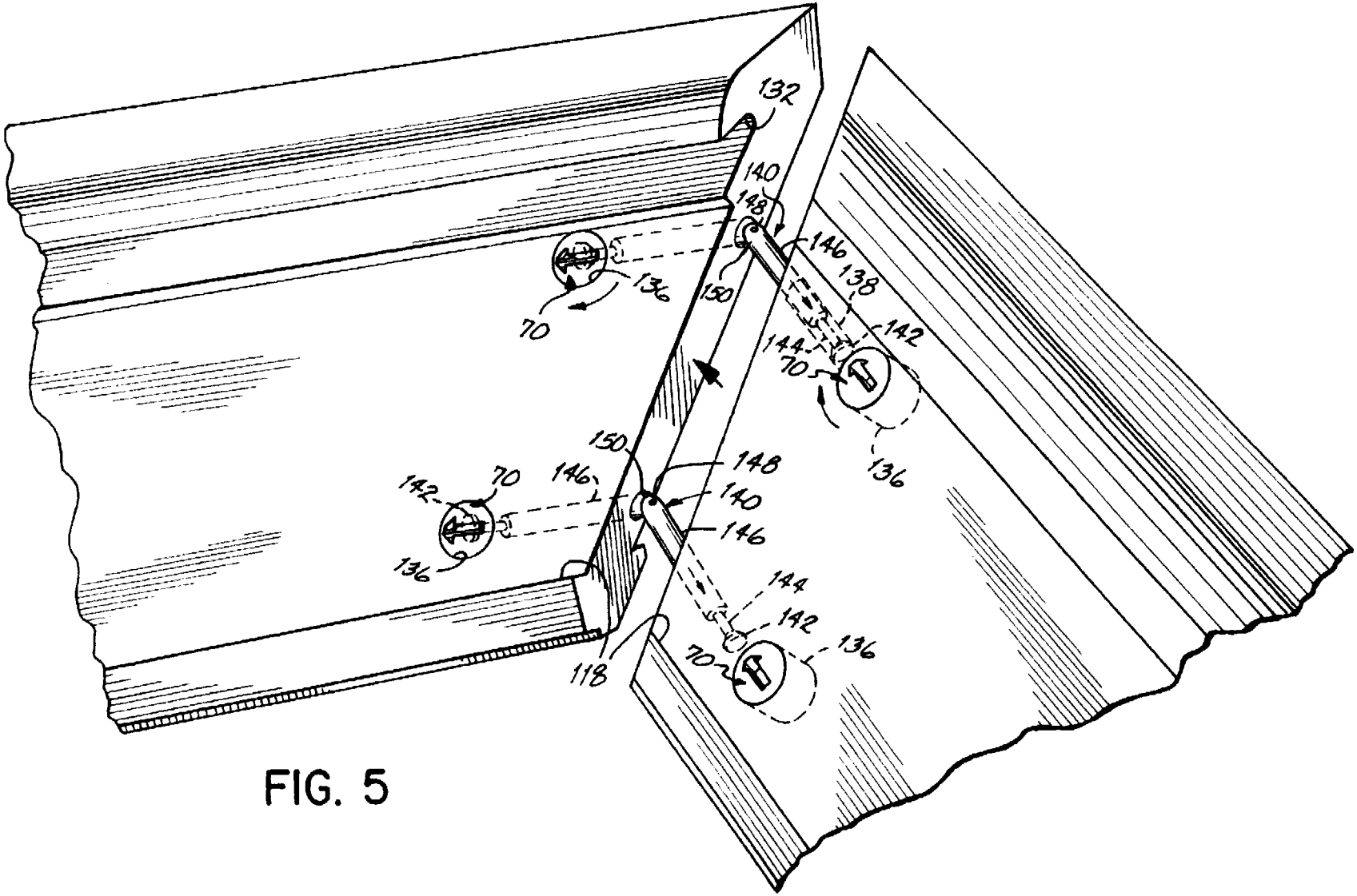
FIG. 5 is an enlarged perspective view showing the cam and post connectors joining adjacent members of the rim of the cap of FIG. 4 together.

The cap 30 according to a presently preferred embodiment of this invention is shown particularly in FIGS. 4–6. Although the cap 30 construction shown and described herein is with reference to the head cap **30*b*, it will be appreciated that the features of this invention can be employed with the foot cap 30*a* or other cap configurations of the casket 10, or other caskets other than the casket illustrated at 10. Referring to FIG. 4, the cap 30 includes a peripheral rim 100 assembled from four rim members 102. A crown 104 is positioned atop the rim 100 and a dish assembly 106 is positioned within an opening on an interior side of the cap 30. The crown 104 is preferably attached to the rim members 102 either by double sided tape or hot melt glue. The dish assembly 106 includes a preferably wooden or molded plastic frame 108 mounted to a lower surface of the crown 104 and including a pair of spaced longitudinal frame members 110, 110 joined to a pair of spaced lateral frame members 112, 112. The frame 108 also includes an intermediate frame member 114 positioned between the lateral frame members 112, 112 and extending across the longitudinal frame members 110, 110 as shown in FIG. 4. The longitudinal frame members 110, 110 are spaced from the ends of the lateral and intermediate frame members 112 and 114. Each end of each lateral and intermediate frame member 112 and 114 includes a lip 116 on a lower edge thereof which is adapted to seat on a shelf 118 of the peripheral rim 100 when the frame 108 is mounted to the lower surface of the crown 104 (FIG. 6). The frame 108 is secured to the rim 100 as by screws 120, glue or other fasteners well known in the art. A groove 122 is formed in a lower surface of each of the longitudinal and lateral frame members 110 and 112 as shown in FIGS. 4 and 6. Alternatively groove 122 could be formed in the lower surface of crown 104**.

The dish assembly 106 also includes four puffing members 124 each constructed of a generally rigid but bendable substrate as is well known in the art. Each puffing member 124 includes an upper edge 126 spaced from a lower edge 128 thereof. The dish assembly 106 also includes a cap panel insert 130 positioned centrally of the four puffing members 124. The cap panel insert 130 may include decorative and otherwise ornamental features as is well known in the art.

Each rim member 102 includes a groove 132 proximate a lower edge thereof as shown in FIGS. 4–6. Each rim member 102 is joined to an adjacent rim member 102 by cooperating post and cam connectors, similar to those shown and described with reference to the frame members 20, 22 and 24 of the shell 12. The cam 70 is inserted into a bore hole 136 on an inner face of the rim member 102. The bore hole 136 is in communication with a post hole 138 extending from the bore hole 136 to an outer edge of the rim member 102. A post 140 which joins adjacent rim members 102 in a presently preferred embodiment of the cap 30 includes a pair of heads 142, 142, one on each opposite end of the post 140. Adjacent to each head 142 on the post is a narrow neck 144 and adjacent to the neck 144 is a trunk section 146 of the post 140. In a presently preferred embodiment, the respective trunk sections 146 of the post 140 are pivotally joined as by a pin 148 or other appropriate connection to form a joint 150 intermediate the heads 142 of the post 140. The respective heads 142 of the post 140 are inserted through the post holes 138 to engage the cams 70 in the bore holes 136, and the rim members 102 are joined together by the rotation of the cams 70 as was previously described and shown in to FIGS. 3A–3D. A post suitable for use in this aspect of the present invention is manufactured by Hafele as "minifix GV mitre joint connector" Part No. 262.12.037. While these posts 140 supplied by Hafele are metal, it is preferred that the posts be fabricated of plastic to minimize the metal components utilized in the casket 10. Alternatively, the rim members 102 could be joined together with hot melt glue or the like.

The puffing members 124 are retained in the cap 30 without the need for staples or other mechanical fasteners which may introduce metal components into the cap 30. Referring to FIG. 6, the lower edge 128 of each puffing member 124 is inserted into the groove 132 proximate the lower edge of the rim member 102. The puffing member 124 is then bowed outwardly and the upper edge 126 thereof is inserted into the groove 122 in the frame 108 of the dish assembly 106. A blunt straight edge tool (not shown) is preferably used to force the edges 126 or 128 of the puffing member 124 into the grooves 122, 132 without damaging the puffing member 124. As a result, the puffing members 124 are securely retained in the dish assembly 106 without the need for metal fasteners such as staples or the like. After the puffing members 124 are inserted into the appropriate grooves 122, 132 in the rim 100 and frame 108, the cap panel insert 130 is positioned into the cap 30 central of the puffing members 124 as is well known by one of ordinary skill in the art. Alternatively, the puffing members 124 may be secured to the cap 30 with the lower edge 128 inserted into the groove 132 in the rim 100 as shown in FIG. 6 and the upper edge 126 of the puffing member 124 attached with double sided tape to the juncture between the crown 104 and the rim 100.

Another optional feature of this invention is an interior lining for the shell 12, made of cloth, paper of the like. The lining is attached to the casket 10 without the use of staples or other metal fasteners. The lining (not shown) may be attached to strips of cardboard, paperboard or another stiff substrate and then inserted into grooves on the interior of the shell 12 similar to that which is shown in FIG. 6 with reference to the puffing members 124. Alternatively, the lining and substrate could be sandwiched between parts of the shell 12 with the lining hanging into the interior of the casket 10. As another option, the lining could be attached directly to the inside of the shell 12 as by tape, hot melt glue, hook and loop fasteners or the like.

As a result of the present invention, the casket 10 including the shell 12 and cap 30 can be readily assembled without the need for specialized training or tools from components fabricated by the manufacturer and shipped in an RTA or knocked-down configuration. Alternatively, the walls 14 and/or cap 30 can be preassembled at the manufacturer for shipment. Furthermore, the shell 12 of the assembled casket 10 is constructed from a plurality of upstanding walls 14 each having peripheral frame 18 and facing panel 28 and does not require additional structural members for reinforcement as in prior art casket shells. In addition, the components of the casket 10 according to this invention are assembled with a minimal amount of metal fasteners or other components which may create problems in the cremation of the casket.

The shell wall panels 28 and bottom panel 54 according to a presently preferred embodiment of the invention are preferably hardboard which is a panel manufactured primarily from interfelted cellulosic fibers which are consolidated under heat and pressure in a hot press to a density of 31 pounds per cubic foot or greater. Advantageously, hardboard is readily consumable in the crematory and does not require the large cremation cycle time required of standard hardwood materials. Hardboard is available in many grades from Wood Fiber Industries under the trade names Duron, Dura-Thrift, Durex, or Durostone. Many other suppliers of acceptable hardboard products exist. The hardboard may be manufactured or treated to improve certain properties such as stiffness, strength, durability, hardness, and resistance to abrasion and moisture.

From the above disclosure of the general principles of the present invention and the preceding detailed description of a preferred embodiment, those skilled in the art will readily comprehend the various modifications to which this invention is susceptible. For example, a casket according to the principles of the present invention can include flat or domed or oval lids. Other materials such as plywood or paper maché could be utilized. Ready-to-assemble type decorative elements such as corners and moldings could be installed on the casket, Other fastening means such as glues, corrugated metal or plastic fasteners and tongue and groove joints could be utilized to attach the panels. Therefore, we desire to be limited only by the scope of the following claims and equivalents thereof.

We claim:

1. A casket comprising:

a cap; and a shell, said shell being closeable by said cap, said shell comprising a bottom and a plurality of individual interconnected upstanding walls;

each said shell wall comprising:

a peripheral frame formed from a plurality of frame members, said peripheral frame defining an opening;

a post coupleable to a cam to join each said frame member to an adjacent frame member, said post having a head thereon and projecting from one of said frame members, a portion of said post and said head being insertable into a hole in said adjacent frame member, said hole being in communication with said cam so that when said post is inserted therein said head engages said cam and upon actuation of said cam said head is captured by said cam to thereby join said frame member to said adjacent frame member; and a panel attached to said frame and spanning said opening.

2. The casket of claim 1 wherein said plurality of walls cooperate with said bottom to form said shell without additional structural members being required to reinforce said shell.

3. The casket of claim 1 wherein said panel is attached to an interior side of said frame on each said wall.

4. The casket of claim 1 wherein said frame members proximate an intersection of adjacent ones of said walls are generally L-shaped with first and second legs, said first leg cooperating with first frame members to form a frame of a first wall and said second leg cooperating with second frame members to form a frame of a second wall adjacent to said first wall.

5. The casket of claim 1 wherein said bottom further comprises:

a bottom frame formed by said frame members of said walls proximate said bottom, said bottom frame defining a bottom opening; and a bottom panel attached to said bottom frame and spanning said bottom opening.

6. The casket of claim 5 wherein said wall frame members proximate an intersection between said walls and said bottom are generally L-shaped with first and second legs, said first legs cooperating with other said wall frame members to form said wall frames and said second legs cooperating to form said bottom frame.

7. The casket of claim 1 wherein each said panel is hardboard.

8. A casket comprising:

a cap; and a shell, said shell being closeable by said cap, said shell comprising a bottom and a plurality of individual interconnected upstanding walls, said plurality of walls cooperating with said bottom to form said shell without additional structural members being required to reinforce said shell;

each said wall comprising:

a peripheral frame formed from a plurality of frame members, said peripheral frame defining an opening; and a panel attached to said frame and spanning said opening;

each said frame having an end, adjacent frame ends being attached to one another with a fastening mechanism having first and second portions each of which is operably associated with one of said adjacent frame ends, said fastening mechanism being configured such that manipulation of one of said portions draws said portions together thereby drawing said adjacent frame ends together.

9. The casket of claim 8 wherein said fastening mechanism comprises:

a post coupleable to a cam to join each said frame member to an adjacent frame member, said post having a head thereon and projecting from one of said frame members, a portion of said post and said head being inserted into a hole in said adjacent frame member, said hole being in communication with said cam so that when said post is inserted therein said head engages said cam and upon actuation of said cam said head is captured by said cam to thereby join said frame member to said adjacent frame member.

10. The casket of claim 8 wherein said panel is attached to an interior side of said frame on each said wall.

11. The casket of claim 8 wherein said frame members proximate an intersection of adjacent ones of said walls are generally L-shaped with first and second legs, said first leg cooperating with first frame members to form a frame of a first wall and said second leg cooperating with second frame members to form a frame of a second wall adjacent to said first wall.

12. The casket of claim 8 wherein said bottom further comprises:

a bottom frame formed by said frame members of said walls proximate said bottom, said bottom frame defining a bottom opening; and a bottom panel attached to said bottom frame and spanning said bottom opening.

13. The casket of claim 12 wherein said wall frame members proximate an intersection between said walls and said bottom are generally L-shaped with first and second legs, said first legs cooperating with other said wall frame members to form said wall frames and said second legs cooperating to form said bottom frame.

14. The casket of claim 8 wherein each said panel is hardboard.

15. The casket of claim 8 wherein manipulation of said one fastening mechanism portion by an amount less than a full turn completely engages said first and second fastening mechanism portions.

16. A kit for assembling a casket, said kit comprising:

a cap;

a plurality of frame members adapted to be joined together to form a plurality of frames, each said frame having an opening;

a plurality of fastening mechanisms each of which comprises a post coupled to a cam and adapted to join selected ones of said frame members to adjacent ones of said frame members, said post having a head thereon and projecting from one of said frame members, said adjacent frame member having a hole therein adapted to receive said post, said hole being in communication with said cam so that when said post is inserted therein said head engages said cam and upon actuation of said cam said head is captured by said cam to thereby join said frame member to said adjacent frame member;

a plurality of panels, each said panel being adapted for attachment to one of said frames and to span said opening thereof to form a wall of the casket; and a bottom, said bottom and said walls cooperating when assembled together to form a shell of the casket, said cap being adapted to be closeable upon said shell.

17. A kit for assembling a casket, said kit comprising:

a cap;

a plurality of frame members adapted to be joined together to form a plurality of frames, each said frame having an opening;

a plurality of fastening mechanisms each of which comprises a post coupled to a cam and adapted to join selected ones of said frame members to adjacent ones of said frame members, said post having a head thereon and protecting from one of said frame members, said adjacent frame member having a hole therein adapted to receive said post, said hole being in communication with said cam so that when said post is inserted therein said head engages said cam and upon actuation of said cam said head is captured by said cam to thereby join said frame member to said adjacent frame member;

a plurality of panels, each said panel being adapted for attachment to one of said frames and to span said opening thereof to form a wall of the casket; and a bottom, said bottom and said walls cooperating when assembled together to form a shell of the casket, said cap being adapted to be closeable upon said shell;

a peripheral rim formed from a plurality of rim members and a crown positioned atop said rim, each said rim member having a groove therein proximate an edge thereof, said crown having a groove forming a part thereof, said rim defining an opening; and a dish assembly positioned within said rim opening;

said dish assembly including a plurality of puffing members, each said puffing member having first and second spaced edges, said first edge of each said puffing member being retained within said groove in one of said rim members, said second edge of each said puffing member being retained in said crown groove.

18. A kit for assembling a casket, said kit comprising:

a cap;

a plurality of frame members adapted to be joined together to form a plurality of frames, each said frame having an opening;

a plurality of panels, each said panel being adapted for attachment to one of said frames and to span said opening thereof to form a wall of the casket; and a bottom, said bottom and said walls cooperating when assembled together to form a shell of the casket, said shell not requiring additional structural members to reinforce said shell, said cap being adapted to be closeable upon said shell;

each said frame having an end, adjacent frame ends adapted to be attached to one another with a fastening mechanism having first and second portions each of which is operably associated with one of said adjacent frame ends, said fastening mechanism being configured such that manipulation of one of said portions draws said portions together thereby drawing said adjacent frame ends together;

a plurality of said fastening mechanisms.

19. A kit for assembling a casket, said kit comprising:

a cap;

a plurality of frame members adapted to be joined together to form a plurality of frames, each said frame having an opening;

a plurality of panels, each said panel being adapted for attachment to one of said frames and to span said opening thereof to form a wall of the casket; and a bottom, said bottom and said walls cooperating when assembled together to form a shell of the casket, said shell not requiring additional structural members to reinforce said shell, said cap being adapted to be closeable upon said shell;

a peripheral rim formed from a plurality of rim members and a crown positioned atop said rim, each said rim member having a groove therein proximate an edge thereof, said crown having a groove forming a part thereof, said rim defining an opening; and a dish assembly positioned within said rim opening;

said dish assembly including a plurality of puffing members, each said puffing member having first and second spaced edges, said first edge of each said puffing member being retained within said groove in one of said rim members, said second edge of each said puffing member being retained in said crown groove.

20. A cap for a casket, said cap comprising:

a peripheral rim formed from a plurality of rim members and a crown positioned atop said rim, each said rim member having a groove therein proximate an edge thereof, said crown having a groove forming a part thereof, said rim defining an opening; and a dish assembly positioned within said rim opening;

said dish assembly including a plurality of puffing members, each said puffing member having first and second spaced edges, said first edge of each said puffing member being retained within said groove in one of said rim members, said second edge of each said puffing member being retained in said crown groove.

21. The cap of claim 20 wherein said cap further comprises:

a frame mounted to a lower surface of said crown, said crown grooves being formed in said frame.

22. The cap of claim 20 further comprising:

a cap panel insert positioned centrally of said puffing members.

23. The cap of claim 20 wherein each said rim member is joined to an adjacent said rim member by a post coupled to a cam, said post having a head thereon and a portion of said post and said head projecting from one of said rim members, said post and said head being inserted into a hole in said adjacent rim member, said hole being in communication with said cam so that when said post is inserted therein said head engages said cam and upon actuation of said cam said head is captured by said cam to thereby join said rim member to said adjacent rim member.

24. The cap of claim 23 wherein each said post has a pair of said heads, said heads being on opposite ends of said post, said post having a joint intermediate said heads to join said rim member to said adjacent rim member and form a miter corner of said rim.

25. The cap of claim 24 wherein said joint is pivotal.

26. A kit for assembling a cap for a casket, said kit comprising:

a plurality of rim members adapted to be joined together to form a peripheral rim having an opening, each said rim member having a groove proximate an edge thereof;

a crown adapted to be positioned atop said rim, said crown having a groove forming a part thereof;

a dish assembly adapted to be positioned within said rim opening;

said dish assembly including a plurality of puffing members, each said puffing member having first and second spaced edges, said first edge of each said puffing member being adapted for insertion into said groove in one of rim members and said second edge of each said puffing member being adapted for insertion into said crown groove when said dish assembly is positioned within said rim.

27. The kit of claim 25 further comprising:

a cap panel insert adapted to be positioned centrally of said puffing members when said dish assembly is positioned within said rim.

28. The kit of claim 26 further comprising:

a post adapted to be coupled to a cam to join adjacent said rim members together, said post having a head thereon and a portion of said post and said head being adapted to project from one of said rim members, said post being capable of insertion into a hole in an adjacent said rim member, said hole being in communication with said cam so that when said post is inserted therein said head engages said cam and upon actuation of said cam said head is captured by said cam to thereby join said rim member to said adjacent rim member.

29. The kit of claim 28 wherein each said post has a pair of said heads, said heads being on opposite ends of said post, said post having a joint intermediate said heads to join said rim member to said adjacent rim member and form a miter corner of said rim.

30. The kit of claim 29 wherein said joint is pivotal.

31. A casket comprising:

a shell having a pair of side walls, a pair of end walls and a bottom wall;

a cap atop said shell and closeable thereon;

each said side and end wall being comprised of a generally rectangular peripheral frame defining an opening and a panel attached to said frame and spanning said opening;

each of said side and end walls being attached to an adjacent one of said side and end walls only at adjacent edges thereof;

each said frame having an end, adjacent frame ends being attached to one another with a fastening mechanism having first and second portions each of which is operably associated with one of said adjacent frame ends, said fastening mechanism being configured such that manipulation of one of said portions draws said portions together thereby drawing said adjacent frame ends together;

said shell thereby being assembled without additional structural members attaching adjacent ones of said side and end walls together and without additional structural members attaching said side and end walls to said bottom wall.

32. The casket of claim 31 wherein said peripheral frames are fabricated from wood and said panels are fabricated from hardboard.

33. The casket of claim 31 wherein manipulation of said one fastening mechanism portion by an amount less than a full turn completely engages said first and second fastening mechanism portions.

34. A casket comprising:

a shell having a pair of side walls, a pair of end walls and a bottom wall;

a cap atop said shell and closeable thereon;

each said side and end wall being comprised of a generally rectangular peripheral frame having sides and ends and defining an opening and a panel attached to said frame and spanning said opening;

each of said frame ends being attached to an adjacent one of said frame with a fastening mechanism having first and second portions each of which is operably associated with one of said adjacent frame ends;

said fastening mechanism being configured such that manipulation of one of said portions draws said portions together thereby drawing said adjacent frame ends together.

35. The casket of claim 34 wherein said peripheral frames are fabricated from wood and said panels are fabricated from hardboard.

36. The casket of claim 34 wherein manipulation of said one fastening mechanism portion by an amount less than a full turn completely engages said first and second fastening mechanism portions.

37. A casket comprising:

a shell having a pair of side walls, a pair of end walls and a bottom wall, and having an exterior;

a cap atop said shell and closeable thereon;

each said side and end wall being comprised of a generally rectangular peripheral frame defining an opening and a panel attached to said frame and spanning said opening;

said panel having first and second sides, both said panel sides being faced with a facing from the group consisting of paper, cloth, plastic, wood veneer, paint and printing, said panel thereby being reversible such that when said panel is attached to said frame a faced panel side will be presented as said casket exterior;

said frame ends being attached to one another with a fastening mechanism having first and second portions each of which is operably associated with one of said adjacent frame ends, said fastening mechanism being configured such that manipulation of one of said portions draws said portions together thereby drawing said adjacent frame ends together.

38. A cap for a casket comprising:

a peripheral rim formed by a plurality of rim members and a crown positioned atop said rim;

each said rim member being joined to an adjacent rim member by a post coupled to a cam, said post having a head thereon and a portion of said post and said head projecting from one of said rim members, said post and said head being inserted into a hole in said adjacent rim member, said hole being in communication with said cam so that when said post is inserted therein said head engages said cam and upon actuation of said cam said head is captured by said cam to thereby join said rim member to said adjacent rim member; and a dish assembly positioned within said rim opening.

39. The cap of claim 38 wherein each said post has a pair of said heads, said heads being on opposite ends of said post, said post having a joint intermediate said heads to join said rim member to said adjacent rim member and form a miter corner of said rim.

40. The cap of claim 39 wherein said joint is pivotal.

41. A casket comprising:

a shell; and a cap closeable upon said shell, said cap comprising:

a peripheral rim formed by a plurality of rim members and a crown positioned atop said rim;

each said rim member being joined to an adjacent rim member by a post coupled to a cam, said post having a head thereon and a portion of said post and said head projecting from one of said rim members, said post and said head being inserted into a hole in said adjacent rim member, said hole being in communication with said cam so that when said post is inserted therein said head engages said cam and upon actuation of said cam said head is captured by said cam to thereby join said rim member to said adjacent rim member; and a dish assembly positioned within said rim opening.

42. A casket comprising:

a casket shell;

a casket cap closeable upon said casket shell;

said casket shell comprising first and second shell frame members, said first frame member including a post attached thereto and said second frame member including a cam rotatably mounted thereto, said post being receivable in said cam, said cam being rotatable to an engaging position wherein said first and second frame members are secured together.

43. A casket comprising:

a casket shell;

a casket cap closeable upon said casket shell;

said casket cap comprising first and second cap rim members, said first rim member including a post attached thereto and said second rim member including a cam rotatably mounted thereto, said post being receivable in said cam, said cam being rotatable to an engaging position wherein said first and second rim members are secured together.

* * * * *

UNITED STATES PATENT AND TRADEMARK OFFICE

CERTIFICATE OF CORRECTION

PATENT NO. : 5,709, 016

DATED : January 20, 1998

INVENTOR(S) : Kenneth J. Gulick et al

It is certified that error appears in the above-indentified patent and that said Letters Patent is hereby corrected as shown below:

Column 13, line 1, replace "claim 25" with -- claim 26 --.

Signed and Sealed this

Twenty-eighth Day of April, 1998

Bruce Lehman

*Attest:*

BRUCE LEHMAN

*Attesting Officer*

*Commissioner of Patents and Trademarks*